US005355599A

United States Patent [19]

Spenneberg, Jr.

[11] Patent Number: 5,355,599

[45] Date of Patent: Oct. 18, 1994

[54] PRESSING PAD FOR PRESSING POCKET FLAPS

[76] Inventor: Evan W. Spenneberg, Jr., 400 Lewis St. #6, Greenville, N.C. 27858

[21] Appl. No.: 21,978

[22] Filed: Feb. 24, 1993

[51] Int. Cl.[5] ..... D06F 87/00

[52] U.S. Cl. ..... 38/141

[58] Field of Search ..... 38/4, 17, 19, 70, 73, 38/140, 143; 223/2, 38, 81, 52.1, 52, 57, 72, 71; 2/247; 112/121.15

[56] References Cited

U.S. PATENT DOCUMENTS

| | | | |
|---|---|---|---|
| 647,549 | 4/1900 | Winteringer | 38/95 |
| 1,250,955 | 12/1917 | Braley | 38/141 |
| 2,556,815 | 6/1951 | Lovelace | 38/141 |
| 2,642,209 | 6/1953 | Davis | 38/70 X |
| 2,823,471 | 2/1958 | Jennings | 223/72 X |
| 3,490,660 | 1/1970 | Sherbondy | 223/71 |

FOREIGN PATENT DOCUMENTS

| | | | |
|---|---|---|---|
| 0555546 | 6/1937 | Denmark | 38/141 |
| 0649718 | 7/1935 | Fed. Rep. of Germany | 38/141 |

*Primary Examiner*—Clifford D. Crowder
*Assistant Examiner*—Ismaez Izaguirre
*Attorney, Agent, or Firm*—Rhodes, Coats & Bennett

[57] ABSTRACT

A pocket-flap pressing device for pressing pocket flaps of different sized pockets located on a garment. The pocket-flap pressing device is used to press the pocket flaps of a standard-issue military uniform that includes four different sized pockets on the military blouse and pants. The pocket-flap pressing device includes a board-like body that is flexible and has a padding attached to one side of the body. A heat resistant, flame-retardant cover encloses the board-like body. The board-like body includes a plurality of edges that each have a length corresponding to one of the different sized pocket flaps. A first edge of the pocket-flap pressing device corresponds to the length of a top pocket located on a military blouse. The second edge of board-like body 42 corresponds with the length of the pocket flaps of the bottom pocket of a military blouse. A third edge of the board-like body corresponds with the length of pocket flaps of the cargo pockets of a pair of military pants. The fourth edge of the board-like body corresponds in length to the back pocket of a pair of military pants. Each of the edges is inserted into a flap opening of a pocket flap such that the buttons of the pocket are positioned between the outer pocket flap and the button. The inserted pressing device protects the pocket from being damaged by an underlying button during the pressing process. A notch positioned adjacent to fourth edge extends into the board-like body such that the board-like body can be fully inserted into the back pockets of the pants.

19 Claims, 4 Drawing Sheets

PRESSING PAD FOR PRESSING POCKET FLAPS

FIELD OF THE INVENTION

The present invention relates generally to pressing garments, and more particularly to pressing pocket flaps on military uniforms.

BACKGROUND OF THE INVENTION

The appearance of a uniform is particularly important in the military. Military personnel are routinely required to undergo uniform inspections where their uniforms are critically reviewed for appearance. To pass a military inspection, the uniform being inspected must be carefully pressed and show no signs of excessive wear. Accordingly, military personnel spend a substantial amount of time preparing their uniforms for inspection.

One type of military uniform is the utility uniform which is a standard issue for various branches of military service. One well-known example of a utility uniform is a camouflage fatigue. The camouflage fatigue includes a blouse and a pair of pants. The blouse has a pair of top pockets and a pair of bottom pockets, while the pants have a pair of back pockets and a pair of cargo pockets. A pair of buttons are attached to a top portion of each pocket. Overlying each of the pair of buttons is an inner pocket find and an outer pocket flap for closing the top opening of the pocket. The inner pocket flap includes a pair of button holes enabling the inner pocket flap to be buttoned to the pocket. The outer pocket flap covers the buttoned inner pocket flap to prevent the buttons holding down the inner pocket find from being torn from the uniform.

One of the more difficult portions of the camouflage fatigue to be pressed are the pocket flaps. If the pocket flaps are pressed while the pocket flaps overlie the buttons, the buttons will rub against the pocket flaps during the pressing process. This rubbing between the pocket flaps and underlying buttons will eventually cause visible wear-and tear in the pocket flaps of the uniform. Such wear-and-tear in the pocket flaps will result in the uniforms being unsuitable for a military uniform inspection.

Military personnel often insert a pressing surface between the pocket flaps and buttons while pressing the pocket flaps such that the buttons do not damage the uniform. For example, a book can be inserted between a pocket flap and a pair of buttons to act as a pressing surface which protects the pocket flaps from damage. However, using a book as a pressing surface for pocket flaps is unsatisfactory because the pocket flaps are of different sizes and cannot properly fit each pocket flap. In addition, use of a book as a pressing surface can require the time consuming task of unbuttoning and buttoning of the pockets to effectively press the pocket flaps. Another method used to press the pocket flaps is cutting an individual piece of cardboard for each different sized pocket. Cutting individual pieces of cardboard sized appropriate for each of the pockets is very time consuming. In addition, the cardboard pieces must be frequently replaced because they become worn and bent after being used only a few times.

SUMMARY OF THE INVENTION

The pocket-flap pressing device of the present invention provides a more effective device and method for pressing different sized pockets on a garment. The pocket-flap pressing device is particularly designed for the pressing of the pocket flaps for the four different sized pockets on the blouse and pants of a standard-issue military uniform. A single pressing device can be used to press all the pocket flaps on a utility uniform despite the pockets and their respective pocket flaps having different sizes.

The pocket-flap pressing device includes a board-like body that is flexible. The board-like body has a foam padding on one side and a heat resistant, fire retardant cover. The board-like body has a plurality of edges with each edge being sized to correspond with a particular pocket on the military uniform. In particular, a first edge corresponds in length with a back pocket and connected pocket flap located on the pants, a second edge corresponds in length with a bottom pocket and connected pocket flap located on the blouse, a third edge corresponds in length with a cargo pocket and connected pocket flap located on the pants, and a fourth edge corresponds in length with a top pocket and connected pocket flap located on the blouse.

To press a pocket flap, the edge of the board-like body corresponding to the pocket flap to be pressed is inserted into a pocket flap between the inner and outer layers. The board-like body provides a pressing surface for the outer layer of the pocket flap and also protects the outer layer of the pocket flap from wear and tear from the button positioned underneath the board-like body. Because the board-like body protects the outer layer of the pocket flap from being worn or indented by the pocket button, the uniform will not be unnecessarily damaged during the pressing of the pocket flaps. The pocket-flap pressing device is simply rotated and the appropriate edge is inserted into the corresponding pocket flap opening for each pocket flap to be pressed.

The construction of the pocket-flap pressing device allows the pocket-flap pressing device to be used repeatedly to press pocket flaps. The sturdy construction of the pressing device prevents damage due to normal wear-and-tear during the pressing process. Thus, unlike cardboard pieces, the pressing device rarely has to be replaced.

Accordingly, it is an object of the present invention to provide a pocket-flap pressing device for pressing pocket flaps of different sized pockets.

Another object of the present invention is to provide a durable pocket-flap pressing device that acts as a pressing surface while pressing pocket flaps and is repeatably usable.

Another object of the present invention is to provide a pocket-flap pressing device usable with standard issue utility uniforms of the military.

Another object of the present invention is to provide a pocket-flap pressing device that protects a uniform from damage during the pressing of the pocket flap.

Other objects and advantages of the present invention will become apparent and obvious from a study of the following description and the accompanying drawings which are merely illustrative of such invention.

DETAILED DESCRIPTION OF THE INVENTION

Figure 1:
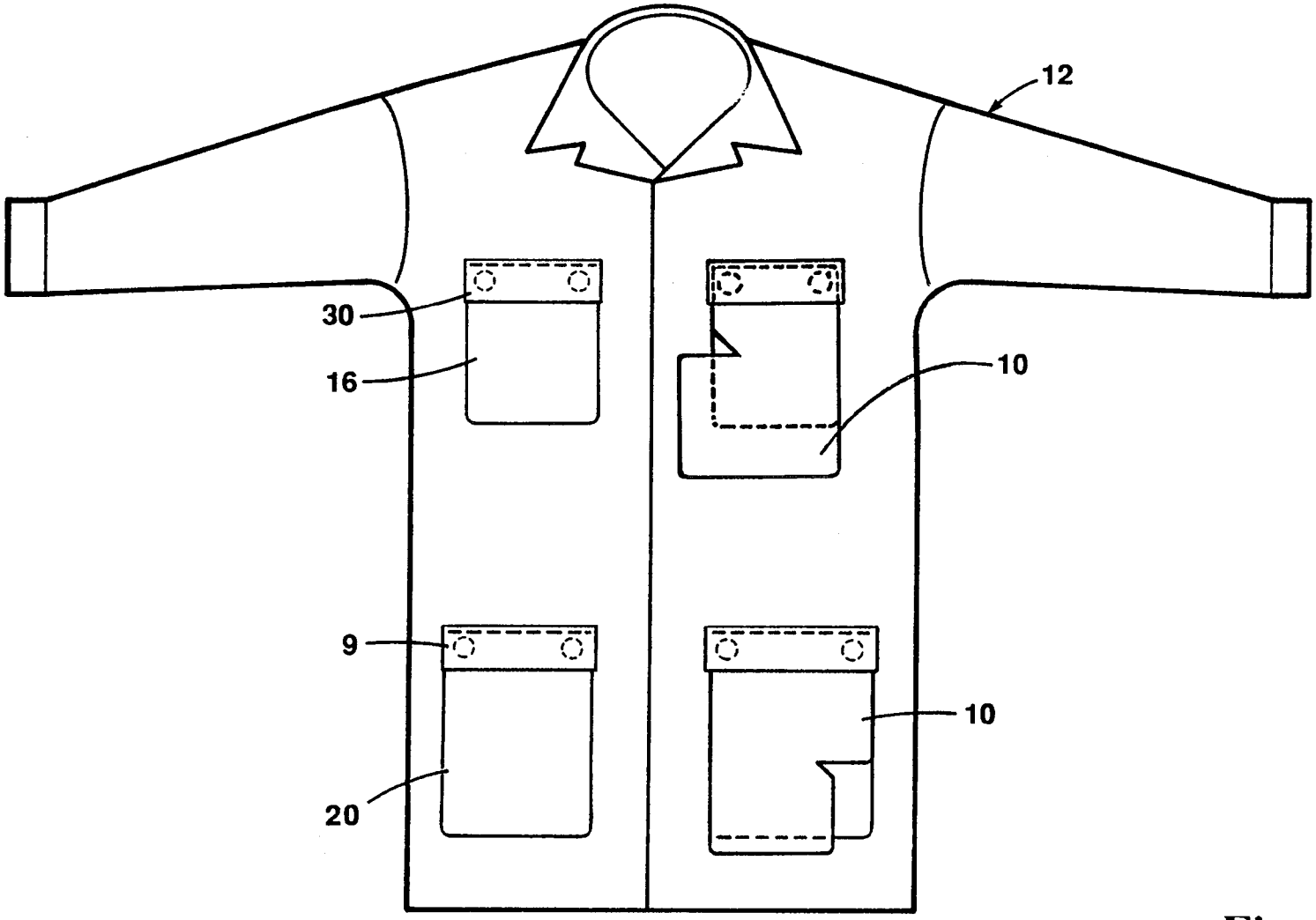
FIG. 1 is a front view of a blouse of a standard issue military uniform showing pocket flap pressing devices inserted into the pocket flaps of a top and a bottom pocket of a military blouse.
Figure 2:
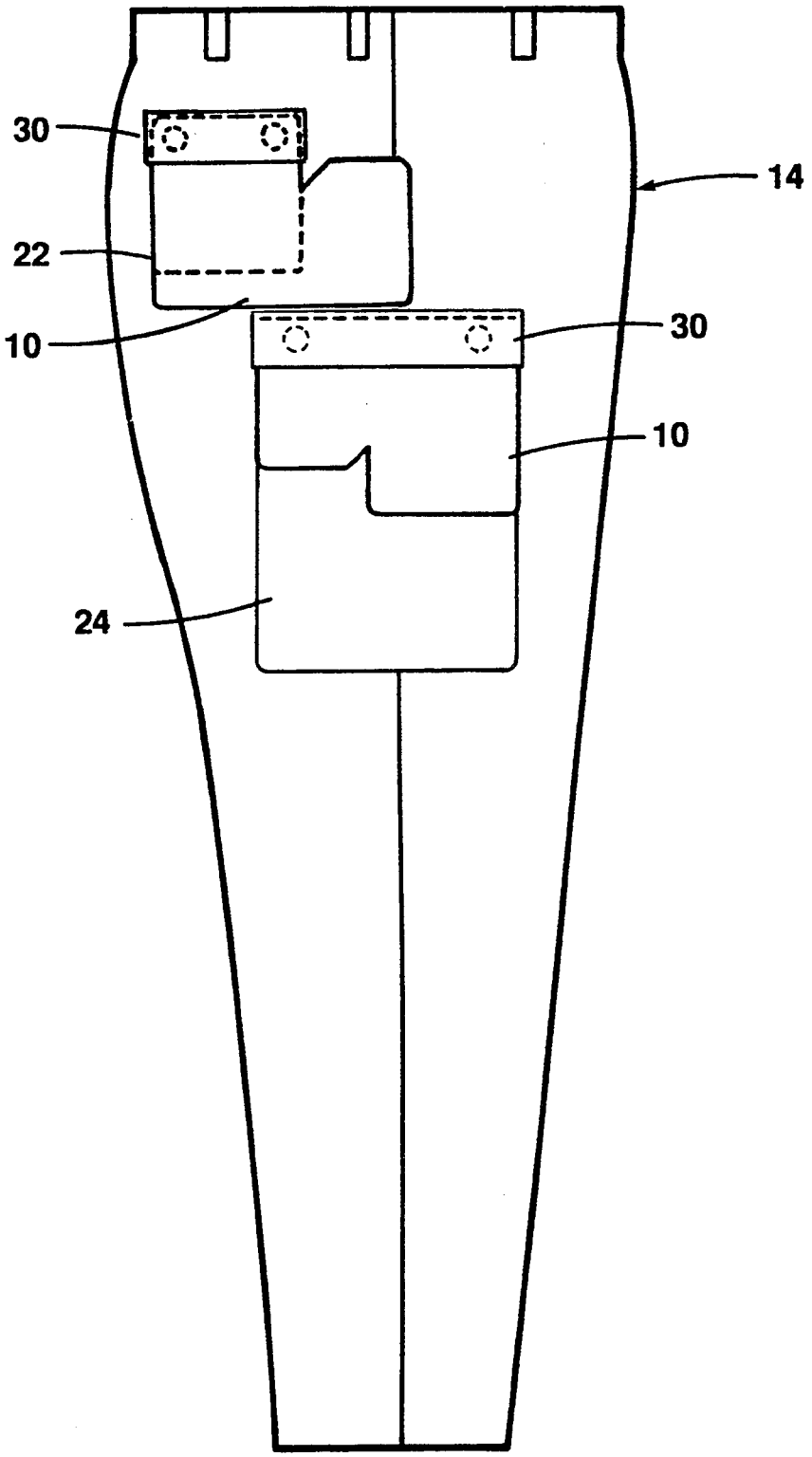
FIG. 2 is a side view of the pants of a standard issue military uniform showing pocket flap pressing devices inserted beneath the pocket flaps of a back pocket and a cargo pocket.

Referring to the drawings, the pocket-flap pressing device of the present invention is indicated generally by the numeral 10. Pocket-flap pressing device 10 can be used as a pressing aid for any type of garment having pocket flaps, but is particularly designed to aid in the pressing of utility uniforms which are standard issue for various branches of military service. Pocket-flap pressing device 10 will be described as applied and used with a standard issue utility uniform, as shown in FIGS. 1 and 2.

A utility uniform includes a blouse 12 and a pair of pants 14. Blouse 12 includes a pair of top pockets 16 and a pair of lower pockets 20. Pants 14 include a pair of back pockets 22 and a pair of cargo pockets 24. FIG. 2 shows the placement of a back pocket 22 and a cargo pocket 24 on one side of pants 14. Pockets 22 and 24 are similarly located on the opposite side of pants 14.

Figure 4:
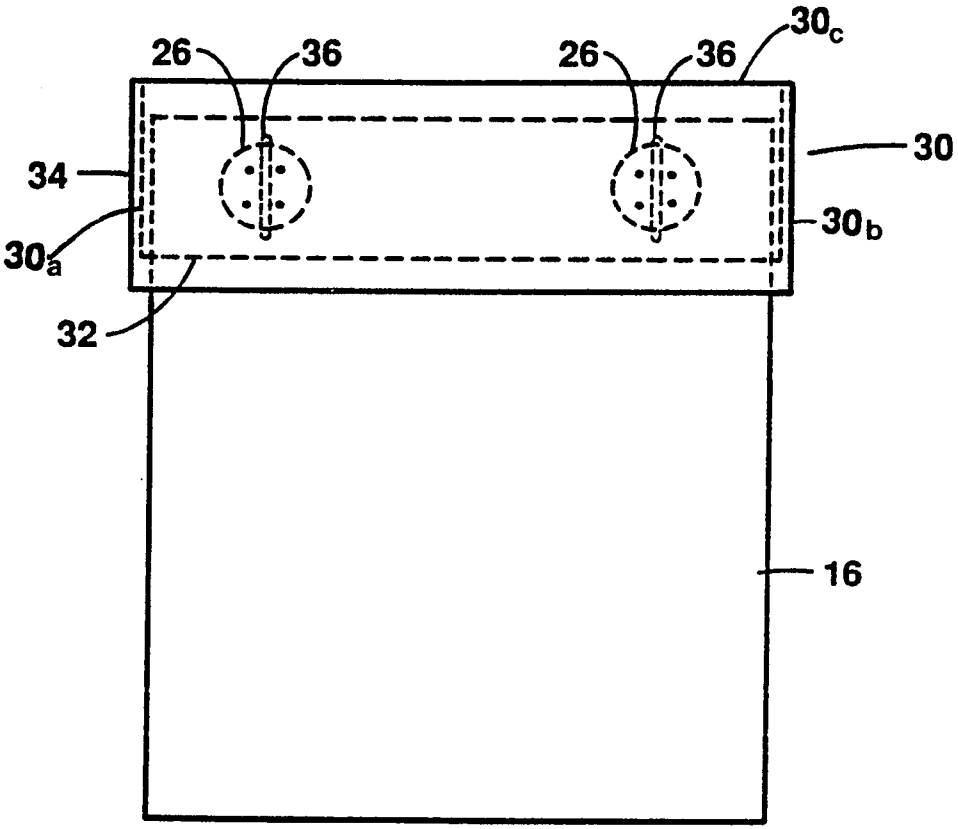
FIG. 4 is a front view of a pocket on a standard issue military uniform.
Figure 3:
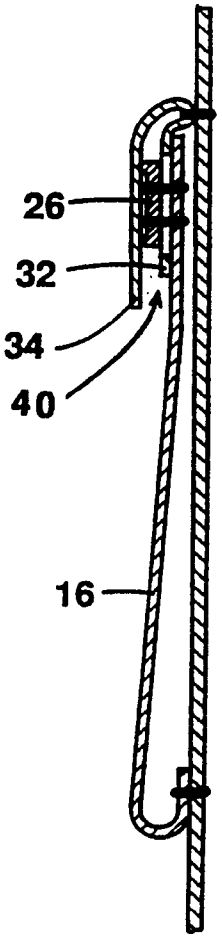
FIG. 3 is a side, cross-sectional view of a pocket on a standard issue military uniform.

Each of the pockets 16, 20, 22, and 24 have a similar construction, but are of different sizes. Top pocket 16, as shown in FIGS. 3 and 4, will be used to describe the construction of a typical pocket of either blouse 12 or pants 14. A pair of buttons 26 are connected to a top portion of top pocket 16. A pocket flap 30 extends over the attached buttons 26. Pocket flap 30 includes an inner layer or inner pocket flap 32 and an outer layer or outer pocket flap 34. Inner pocket flap 32 includes a pair of spaced button holes 36 corresponding with the spacing between the underlying buttons 26. When a top pocket 16 is buttoned, buttons 26 extend through button holes 36 and are positioned between the inner pocket flap 32 and outer pocket flap 34. Inner pocket flap 32 functions to hold pocket flap 30 in a buttoned position, while outer pocket flap 34 acts as a protective guard or cover to prevent the buttons 26 from being torn off the uniform. Each of the pockets 16, 20, 22, and 24 are constructed in a similar manner, but have a different length pocket flap.

As shown in FIGS. 3 and 4, a pocket flap opening 40 is disposed between inner layer 32 and outer layer 34. The pocket flap opening extends lengthwise from a first side border 30*a* to a second side border 30*b*. First and second side borders 30*a* and 30*b* are borders where inner layer 32 and outer layer 34 are sewn and connected together. Pocket flap 34 is sewn to and hingedly connected to blouse 12 along top border 30*c*.

Pocket-flap pressing device 10 is used as an aid to press pocket flaps 30. Pocket-flap pressing device 10 includes a flexible, board-like body 42. Body 42 is preferably constructed of a thin, tin plate. Other flexible materials that allow the body 42 to be flexed may also be used. Board-like body 42 includes a padding 44 adhered to one side. The preferred padding is a foam material. A heat-retardant, fire resistant cover is used to enclose the board-like body 42 and padding 44. Cover 46 and padding 44 is made of material which is typically used on prior art ironing boards. Likewise, padding 44 is constructed of a material particularly used on prior art ironing boards.

Figure 5:
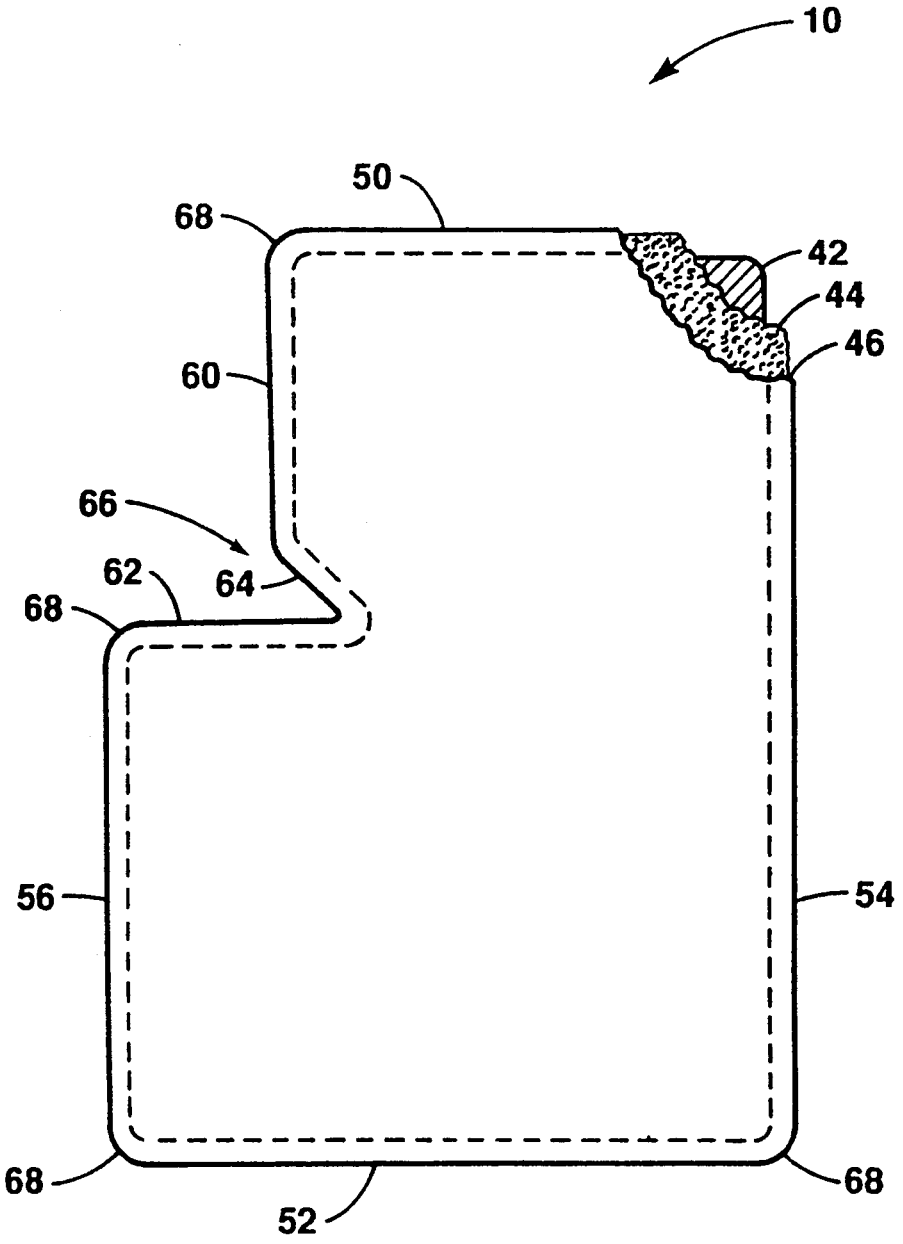
FIG. 5 is a plan view of a pocket flap pressing device with a portion cut-away to illustrate its construction.

Referring to FIG. 5, pocket-flap pressing device 10 includes a first edge 50, a second edge 52, a third edge 54, a fourth edge 56, a fifth edge 60, a sixth edge 62, and a seventh edge 64. First edge 50 and second edge 52 oppose each other and are parallel. Third edge 54 and fourth edge 56 oppose each other and are also parallel. First and second edges 50 and 52 are perpendicular to third and fourth edges 54 and 56. Fifth edge 60 extends perpendicularly from first edge 50 and towards second edge 52. Sixth edge 62 extends perpendicularly from fourth edge 56 and towards third edge 54. Sixth edge 62 is connected to fifth edge 60 by a seventh edge 64. Seventh edge 64 extends at an angle from fifth edge 60 and connects with sixth edge 62 to form a V) gap or notch 66 in the board-like body 42.

The edges of pocket-flap pressing device 10 have lengths that enable board-like body 42 to be inserted and fitted into the flap openings 40 to function as an appropriately sized pressing surface for each of the different sized pockets 16, 20, 22, and 24. First edge 50, second edge 52, third edge 54, and fourth edge 56 are the edges of pocket-flap pressing device 10 which are inserted into flap openings 40 such that board-like body 42 acts as a pressing surface for pocket flaps 30. The length of first edge 50, second edge 52, third edge 54, and fourth edge 56 each correspond with a different sized pocket of blouse 12 and pants 14. First edge 50 has a length approximately equal to flap openings 40 of top pockets 16. Second edge 52 has a length slightly less than the length of flap opening 40 of bottom pocket 20. Third edge 54 has a length approximately equal to the length of flap opening 40 of cargo pockets 24. Fourth edge 56 has a length which is slightly less than the length of the flap opening 40 of back pocket 22. Each of the insertable edges 50, 52, 54, and 56 can be inserted fully into their respective flap openings so that the board-like body 42 acts as a pressing surface for substantially the entire area of the outer pocket flaps 34. The lengths of the fifth and sixth edges 60 and 62 are sized to allow first edge 50 and fourth edge 56 to be fully inserted into pockets 22 and 16, respectively. As shown in FIG. 5, notch 66 allows fourth edge 56 to be fully inserted into flap opening 40 of back pocket 22. Without notch 66, fifth edge 60 would interfere with the insertion of board-like body 42 into flap openings 40 of back pockets 22. The corners 68 of board-like body 42 are rounded to allow pressing device 10 to be more easily inserted into pocket-flap openings 40.

Pocket-flap pressing device 10 is used to press a blouse 12 and pants 14 of a military uniform as follows. Referring to FIGS. 1 and 2, a user presses top pockets 16 by inserting first edge 50 into flap opening 40 of top pockets 16. Notch 66 enables the user to insert board-like body 42 fully into flap opening 40 such that inner and outer pocket flaps 32 and 34 are disposed on opposite sides of board-like body 42. Buttons 26 for pocket 16 remain buttoned to inner pocket flap 32 during the ironing process such that the buttons 26 are positioned on one side of board-like body 42 and outer pocket flap 34 is positioned on the opposite side of board-like body 42. With board-like body 42 inserted, outer pocket flap 34 is pressed. Because buttons 26 are located behind board-like body 42, the buttons do not cause wear-and-tear in the outer pocket flap 34 as the pocket flap 30 is ironed. As described, pocket-flap pressing device 10 allows a person to iron the pocket flaps without having to unbutton or rebutton pocket flaps 30, and thus, increases the speed at which pocket flaps 30 can be pressed. The outer pocket flaps 30 of pockets 20, 22, and 24 are pressed in a similar manner with board-like body 42 inserted as shown in FIGS. 1 and 2.

Pocket-flap pressing device 10 allows an individual to use a single device for pressing four different sized pockets located on utility uniforms of the military. Thus, the pressing device 10 allows a user to press the pocket flaps 30 of a military uniform in a more effective manner.

The present invention may, of course, be carried out in other specific ways than those herein set forth without departing from the spirit and essential characteristics of the invention. For example, a pocket flap pressing device having only three insertable edges could be constructed. Because first edge 50 and fourth edge 56 are close in length, a modified pressing device could be constructed where either first edge 50 or fourth edge 56 could be used for both top pocket 16 and back pocket 22. Such a modified pressing device, however, would not as effectively fit both top pocket 16 and back pocket 22 of a utility uniform. The present embodiments are, therefore, to be considered in all respects as illustrative and not restrictive and all changes coming within the meaning and equivalency range of the appended claims are intended to be embraced therein.

What is claimed is:

1. A pocket flap pressing device for a military uniform having at least four different-sized pockets with each pocket having an associated pocket flap that is pivotally connected to the uniform, each pocket flap including an outer layer and an inner layer that are connected together to form a pocket flap opening that extends lengthwise from a first side border to a second side border, the pocket flap pressing device comprising:

(a) a board-like member having a first edge, a second edge, a third edge, and a fourth edge of different lengths;

(b) the first edge having a first predetermined length corresponding to the length of a first pocket flap and a first pocket flap opening so as to enable the first edge to be inserted into the first pocket-flap opening and beneath the outer layer of the first pocket flap such that the board-like member underlies the outer layer and extends between the first side border and the second side border of the first pocket flap;

(c) the second edge having a second predetermined length corresponding to the length of a second pocket flap and second pocket flap opening so as to enable the second edge to be inserted into the second pocket flap opening and beneath the outer layer of the second pocket flap such that the board-like member underlies the outer layer and extends between the first side border and the second side border of the second pocket flap;

(d) the third edge having a third predetermined length corresponding to the length of the third pocket flap and third pocket flap opening so as to enable the third edge to be inserted into the third pocket flap opening and beneath the outer layer of the third pocket flap such that the board-like member underlies the outer layer and extends between the first side border and the second side border of the third pocket flap; and (e) the fourth edge having a third predetermined length corresponding to the length of a fourth pocket flap and fourth pocket flap opening so as to enable the fourth edge to be inserted into the fourth pocket flap opening and beneath the outer layer of the fourth pocket flap such that the board-like member underlies the outer layer and extends between the first side border and the second side border of the fourth pocket flap.

2. The pressing device of claim 1 wherein the first edge opposes the second edge and the third edge opposes the fourth edge, and wherein the third edge extends from the first edge to the second edge and the fourth edge extends from the second edge towards the first edge, the pressing device further including a fifth edge and a sixth edge, the sixth edge extending from the fourth edge and towards the third edge, and the fifth edge extending from the first edge towards the sixth edge.

3. The pressing device of claim 2 further including a notch means disposed between the fourth edge and the fifth edge for inserting the fourth edge into a pocket flap opening so that the pocket flap extends past the fifth edge and into the notch.

4. The pressing device of claim 3 wherein the notch means includes a seventh edge extending from the fifth edge towards the third edge and connecting to the sixth edge.

5. The pressing device of claim 4 wherein the first and second edges are parallel, the third and fourth edges are parallel, and the fifth edge is perpendicular to the sixth edge.

6. The pressing device of claim 2 wherein the length of the first edge is less than the length of the fourth edge, the length of the fourth-edge is less than the length of the second edge, and the second edge is less than the length of the third edge.

7. The pressing aid of claim 1 further including a heat resistant material covering the board-like member.

8. The pressing aid of claim 7 wherein the board-like member is flexible.

9. The pressing aid of claim 7 wherein the board-like member further includes a padding on at least one side.

10. A pocket flap pressing device for a military uniform having at least four different-sized pockets with each pocket having an associated pocket flap that is pivotally connected to the uniform, each pocket flap including an outer layer and an inner layer that are connected together to form a pocket flap opening that extends lengthwise from a first side border to a second side border, the pocket flap pressing device comprising:

(a) a board-like member having a first edge, a second edge, a third edge, and a fourth edge of different lengths;

(b) the first edge having a first predetermined length corresponding to the length of a first pocket flap and a first pocket flap opening so as to enable the first edge to be inserted into the first pocket-flap opening and beneath the outer layer of the first pocket flap such that the board-like member underlies the outer layer and extends between the first side border and the second side border of the first pocket flap;

(c) the second edge having a second predetermined length corresponding to the length of a second pocket flap and second pocket flap opening so as to enable the second edge to be inserted into the second pocket flap opening and beneath the outer layer of the second pocket flap such that the board-like member underlies the outer layer and extends between the first side border and the second side border of the second pocket flap; and (d) the third edge having a third predetermined length corresponding to the length of the third pocket flap and third pocket flap opening so as to enable the third edge to be inserted into the third pocket flap opening and beneath the outer layer of the third pocket flap such that the board-like member underlies the outer layer and extends between the first side border and the second side border of the third pocket flap.

11. The pressing aid of claim 10 further including a heat resistant material covering the board-like member.

12. The pressing aid of claim 11 wherein the board-like member is flexible.

13. The pressing aid of claim 11 wherein the board-like member further includes a padding on at least one side.

14. A pocket-flap pressing method for a military uniform having at least four different-sized pockets with each pocket having an associated pocket flap that is pivotally connected to the uniform, each pocket flap including an outer layer and an inner layer that are connected together to form a pocket flap opening that extends lengthwise from a first side border to a second side border, the pocket-flap pressing method comprising the steps of:

(a) pressing a first pocket flap having a first pocket flap opening with a board-like member having a first edge, a second edge, a third edge, and a fourth edge of different lengths, wherein the first edge has a predetermined length corresponding to the length of the first pocket flap and first pocket flap opening, and wherein the step of pressing the first pocket flap includes inserting the first edge into the first pocket flap opening and beneath the outer layer of the first pocket flap such that the board-like member underlies the outer layer and extends between the first side border and the second side border of the first pocket flap;

(b) pressing a second pocket flap having a second pocket flap opening with the board-like member, wherein the second edge has a predetermined length corresponding to the length of the second pocket flap and second pocket flap opening, and wherein the step of pressing the second pocket flap includes inserting the second edge into the second pocket flap opening and beneath the outer layer of the second pocket flap such that the board-like member underlies the outer layer and extends between the first side border and the second side border of the second pocket flap;

(c) pressing a third pocket flap having a third pocket flap opening with the board-like member, wherein the third edge has a predetermined length corresponding to the length of the third pocket flap and third pocket flap opening, and wherein the step of pressing the third pocket flap includes inserting the third edge into the third pocket flap opening and beneath the outer layer of the third pocket flap such that the board-like member underlies the outer layer and extends between the first side border and the second side border of the third pocket flap.

15. The pocket-flap pressing method of claim 14 further including the step of pressing a fourth pocket flap having a fourth pocket flap opening with the board-like member, wherein the fourth edge has a predetermined length corresponding to the length of the fourth pocket flap and fourth pocket flap opening, and wherein the step of pressing the fourth pocket flap includes inserting the fourth edge into the fourth pocket flap opening and beneath the outer layer of the fourth pocket flap such that the board-like member underlies the outer layer and extends between the first side border and the second side border of the fourth pocket flap.

16. The pocket-flap pressing method of claim 14 wherein the board-like member includes a heat resistant material covering.

17. The pocket-flap pressing method of claim 14 wherein the board-like member is flexible.

18. The pocket-flap pressing method of claim 14 wherein the board-like member further includes a padding on at least one side.

19. The pocket-flap pressing method of claim 14 wherein one the first edge includes a notch means, and wherein the step of pressing the first pocket flap further includes inserting the first edge into the first pocket flap opening so as to position a portion of the first pocket flap into the notch such that the board-like member is fully inserted into the first pocket flap opening.

* * * * *